United States Patent [19]

Long et al.

[11] 4,394,555

[45] Jul. 19, 1983

[54] SWITCH ASSEMBLY WITH PIVOTED ACTUATOR

[75] Inventors: Donald A. Long; Thomas R. Sowash, both of Anderson, Ind.

[73] Assignee: General Motors Corporation, Detroit, Mich.

[21] Appl. No.: 271,690

[22] Filed: Jun. 8, 1981

[51] Int. Cl.[3] ..... H01H 13/52

[52] U.S. Cl. ..... 200/159 R; 200/292; 200/340

[58] Field of Search ..... 200/5 A, 5 R, 159 A, 200/159 B, 159 R, 292, 340, 338, 339, 157

[56] References Cited

U.S. PATENT DOCUMENTS

| | | | |
|---|---|---|---|
| 3,484,632 | 12/1969 | Opalenik et al. | 200/157 |
| 3,867,591 | 2/1975 | Nordeen | 200/52 R |
| 3,867,596 | 2/1975 | Schadow | 200/159 R |
| 3,971,906 | 7/1976 | Sahrbacker | 200/157 |
| 4,000,389 | 12/1976 | Misson et al. | 200/292 |
| 4,096,364 | 6/1978 | Lynn et al. | 200/5 A |
| 4,136,269 | 1/1979 | Weidler | 200/159 A |

FOREIGN PATENT DOCUMENTS

| | | | |
|---|---|---|---|
| 48124 | 3/1982 | European Pat. Off. | 200/157 |

*Primary Examiner*—John W. Shepperd
*Attorney, Agent, or Firm*—Warren D. Hill

[57] ABSTRACT

A printed circuit board carrying a keyboard switch is mounted perpendicularly to a switch panel. An actuator having a push button portion extending through an aperture in the panel is pivotally mounted for movement about an axis parallel to both the panel and the circuit board. An operator portion of the actuator extends into contact with the switch so that a force on the push button generally parallel to the circuit board effects switch operation in a direction perpendicular to the circuit board.

4 Claims, 5 Drawing Figures

SWITCH ASSEMBLY WITH PIVOTED ACTUATOR

Figure 1:
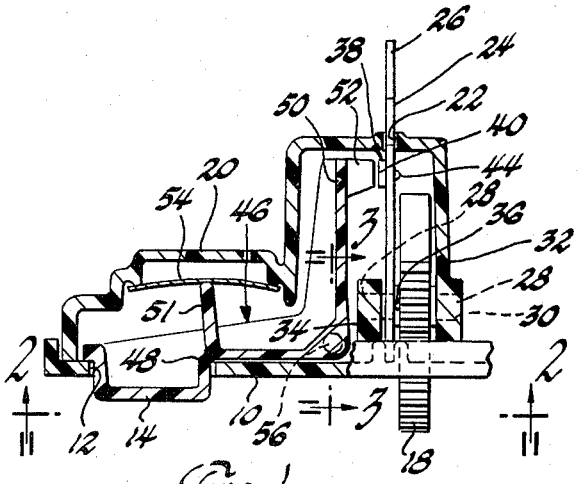

This invention relates to a switch assembly and particularly to such an assembly having a pivotally mounted switch actuator.

Commonly it is desirable to use a push type keyboard switch in conjunction with a manually operated push button particularly where a digital or pulse signal is desired. Conventionally, a printed circuit mounted parallel to a keyboard panel has one or more keyboard switches and a corresponding push button is mounted in an aperture of the panel so that each switch is operated by a push button having a movement perpendicular to the circuit board. Oftentimes it is preferable to locate the circuit board perpendicular to the switch panel because of space limitations, a lower cost or other considerations.

It is an object of this invention to provide a switch assembly having a circuit board transverse to a switch panel, a switch mounted on the circuit board and an actuator for operating the switch.

The invention is carried out by a panel support having an aperture, a circuit board extending transverse to the panel and spaced from the aperture, a switch mounted on the circuit board and a switch actuator pivotally mounted on the panel and having a push button extending through the panel aperture and an operator portion extending toward the switch for switch operation when force is applied to the push button in a direction perpendicular to the panel.

Figure 2:
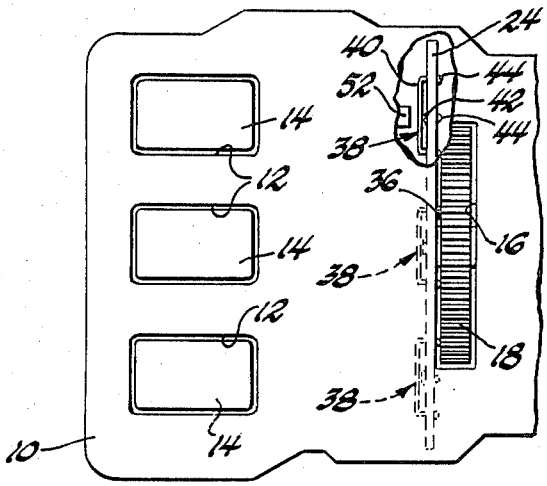
Figure 3:
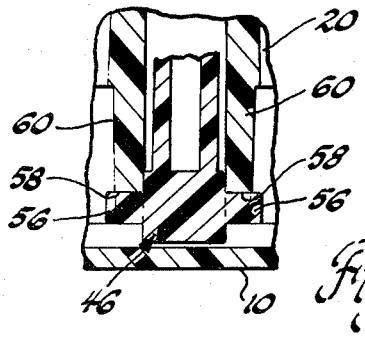
Figure 4:
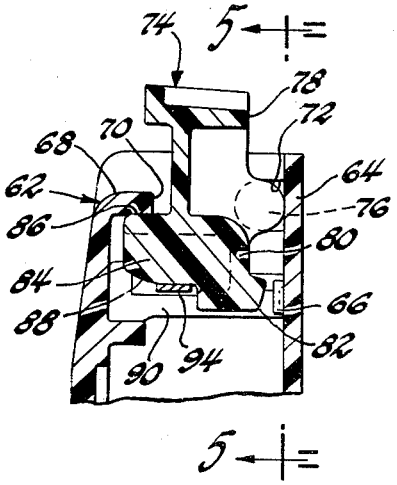
Figure 5:
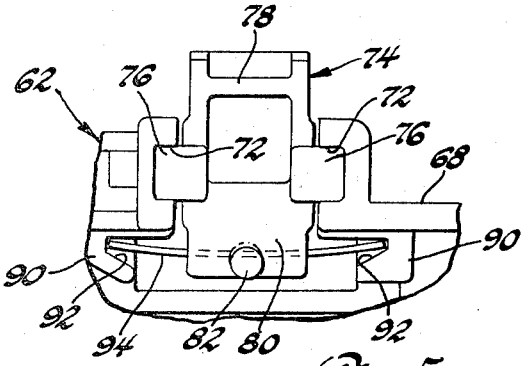

The above and other advantages will be made more apparent from the following specification taken in conjunction with the accompanying drawings wherein like reference numerals refer to like parts and wherein:

FIG. 1 is a cross-sectional view of a switch assembly according to the invention, FIG. 2 is an elevational view of a switch assembly of FIG. 1 taken along lines 2—2, FIG. 3 is a cross-sectional view of a portion of the switch assembly of FIG. 1 taken along lines 3—3, FIG. 4 is a cross-sectional view of a second embodiment of a switch assembly according to the invention, and FIG. 5 is a view of the switch actuator of the assembly of FIG. 4 taken along line 5—5.

Referring to FIGS. 1, 2 and 3 a support or switch panel 10 has a plurality of openings 12 each containing a push button 14 and an additional opening 16 through which a thumb wheel 18 protrudes. These switch panels may be of any desired material although a molded plastic panel is preferred. A molded plastic housing 20 mounted behind the panel 10 is secured to the panel by fusion or fastening means, not shown. A slot 22 in the rear surface of the housing 20 is adapted to receive a printed circuit board 24 which is primarily located within the housing but has a terminal portion 26 extending outwardly through the slot. The circuit board is mounted generally perpendicularly to the face of the switch panel 10 and spaced a small distance from the apertures 12 adjacent to the aperture 16. The housing member 20 together with the panel 10 and the circuit board 24 defines a switch assembly cavity. The thumb wheel 18 which is parallel to and adjacent to the circuit board 24 has axle portions 28 journalled in openings 30 defined in walls 32 and 34 of the housing 20 on either side of the thumb wheel. The circuit board 24 has an aperture, not shown, allowing one of the axle portions 28 to extend therethrough to an inner wall 34. The thumb wheel 18 carries contacts 36 which will cooperate with a resistive path, now shown, on the circuit board 24 to define a potentiometer. Since such a potentiometer structure is well known and does not form a part of the invention herein, it is not described in detail. The potentiometer is presented as an example of an instance where it is desirable to use a circuit board extending transverse or perpendicular to the face of a switch panel.

The circuit board 24 carries on its surface nearest the push buttons 14 a plurality of keyboard switches 38, one for each push button. Each switch 38 comprises a U-shaped bridging contact 40 having both legs secured to the circuit board straddling a contact button 42. The bridging contact 40 is slightly spaced from the contact 42 and is formed so as to move against the contact 42 with a snap action when a force is applied to the contact 40 perpendicular to the circuit board 24. The contacts 40 and 42 have ends 44 which extend through the circuit board for soldering to printed circuit conductors. The keyboard switches 38 are well known in the art and are available, for example, as keyboard switch model 62644-1 from AMP, Inc. of Harrisburg, Pennsylvania.

A generally L-shaped switch actuating member 46 is pivotally mounted within the switch cavity and comprises a push button portion 48 extending generally parallel and adjacent to the inner surface of the panel 10 and an operating portion 50 extending generally parallel to and spaced from the circuit board 24. A switch contactor 52 is integrally formed on the end of the operating portion 50 and is disposed adjacent a switch 38. The push button 14 is an integral part of the push button portion 48 and is molded so as to extend out of the switch cavity through the opening 12. An integral finger 51 projects from the push button portion into the switch cavity at an angle nearly perpendicular to the panel 10. It engages a leaf spring 54 which is seated inside the housing 20. The leaf spring serves to bias the actuating member 46 in a direction to hold the push button portion against the inner surface of the panel 10. This biasing force serves chiefly to prevent rattling of the actuating member 46 and also, in conjunction with the snap action of the switch 38, provides the desired tactile feel to the push button operation. Instead of the leaf spring 54, other biasing means, for example, a resilient plastic or rubber foam may be used.

The pivot structure of the actuator 46 is located at the apex of the angle formed by the push button portion and the operating portion and is best shown in FIG. 3. A pair of pins 56 extend from either side of the actuating member 46 and are journalled in U-shaped notches 58, molded in walls 60 which are integral with the housing 20 and extend into the switch cavity to a point near the inner surface of the panel 10 so that the actuator 46 is pivotally movable with respect to the housing 20 and is trapped between the wall 60 and the panel 10.

It will be evident that in operation when a force is manually applied to the push button 14 in a direction perpendicular to the panel 10 and therefore parallel to the circuit board 24, the actuating member will pivot or rock slightly causing the switch contactor 52 to engage the bridging contact 40 of the switch 38 to bias that contact against the button contact 42 thereby closing the switch. When the operating force is removed from the push button, the resilient bridging contact 40 will resume its normal position thereby opening the switch and the spring 54 will move the actuator to its normal nonactuated position.

A second embodiment of the invention is shown in FIGS. 4 and 5. There a housing or support 62 of molded plastic has an open side which abuts a circuit board 64 carrying a keyboard switch 66 which is the same as the switch 38 described for the previous embodiment. The housing 62 has an end wall 68 with a face which extends generally perpendicular to the circuit board 64 and defines an opening or aperture 70. A portion of the housing 62 adjacent the circuit board 64 defines a U-shaped opening 72. A switch actuator 74 has a pair of pivot pins 76 journalled in the apertures 72 which allows rocking motion of the actuator and has a push button portion 78 comprising an outer end extending from the pivot pins outwardly through the opening 70 in the end wall, an operator portion 80 comprising an inner end extending from the pivot pins into the switch cavity. The inner and outer ends are positioned in line and have a common longitudinal axis. The pivot pins 76 are laterally spaced from the axis at one side of the actuator so that a force applied along the axis tends to rock the actuator. A switch contactor 82 extends laterally from the inner end at the same side of the actuator as the pivot pins 76 and is positioned adjacent the switch 66 for selective contact thereof. The operator portion also includes a lateral projection 84 on the side opposite the pins 76 which has a shoulder portion 86 normally resting in engagement with the inner surface of the end wall 68 and also has an end surface 88. As best shown in FIG. 5, the housing includes a pair of spaced ears 90 on the inner surface of the housing located at points on opposite sides of the keyboard switch 66. The ears 90 define notches 92 facing one another for retaining the ends of a leaf spring 94. The leaf spring spans the space between the ears and its center portion bears against the surface 88 to resiliently hold the actuator in nonactuated position.

In operation, a manual depression of the push button portion 78 in a direction perpendicular to the face of the end wall causes the actuator 74 to rock about the pivot pin 76 so that the switch contactor 82 will operatively engage the keyboard switch 66. The leaf spring 94 provides return motion to the actuator 74 when the manual force is removed to seat the shoulder 86 against the end wall 68 to prevent rattling of the actuator.

It will thus be seen that in accordance with the present invention there is provided a switch assembly having an actuator operated by a push button and pivoted about an axis so that a portion of the actuator can operate a keyboard switch located on a circuit board which is disposed parallel to the direction of push button movement. This unique structure allows great flexibility in design of switch panels as well as increased utilization of available space and lower switch assembly costs.

The embodiments of the invention in which an exclusive property or privilege is claimed are defined as follows:

1. A switch assembly comprising a support having a face, an aperture defined in the face, a circuit board mounted on the support, the board surface extending transverse to the said face, a switch including a movable contact and a stationary contact mounted on the circuit board and arranged for operation between open and closed state by movement of the movable contact generally perpendicular to the circuit board, and a switch actuator having pivot means mounted on the support adjacent the aperture for rocking movement about an axis substantially parallel to the circuit board and the face, the actuator having a push button portion extending away from the circuit board in one direction from the pivot means and protruding through the aperture to allow manual movement of the actuator and having an operator portion extending in another direction from the pivot means to the switch for switch operation upon actuator movement, whereby a force applied to the push button portion in a direction generally perpendicular to the face is effective to operate the switch.

2. A switch assembly comprising a support having a face, an aperture defined in the face, a circuit board mounted on the support, the board surface extending transverse to the said face in a plane laterally spaced from the aperture, a switch including a movable contact and a stationary contact mounted on the circuit board and arranged for operation between open and closed state by movement of the movable contact generally perpendicular to the circuit board, a switch actuator having pivot means mounted on the support adjacent the aperture for rocking movement between the switch in one extreme and the support in the other extreme, about an axis substantially parallel to the circuit board and the face, the actuator having a push button portion extending away from the circuit board in one direction from the pivot means and protruding through the aperture to allow manual movement of the actuator and having an operator portion extending in another direction from the pivot means to the switch for switch operation upon actuator movement, whereby a force applied to the push button portion in a direction generally perpendicular to the face is effective to operate the switch, and spring means mounted on the support and biased against the actuator in a direction to urge the actuator away from the switch and against the support.

3. A switch assembly comprising a support having a face, an aperture defined in the face, a circuit board mounted on the support, the board surface extending substantially at right angles to the said face in a plane laterally spaced from the aperture, a switch including a movable contact and a stationary contact mounted on the circuit board and arranged for operation between open and closed state by movement of the movable contact generally perpendicular to the circuit board, and a generally L-shaped switch actuator having pivot means at the apex of the "L" mounted on the support adjacent the aperture for rocking movement about an axis substantially parallel to the circuit board and the face, the actuator having a push button portion extending generally parallel to the face and away from the circuit board in one direction from the pivot means and protruding through the aperture to allow manual movement of the actuator and having an operator portion extending substantially at right angles to the face from the pivot means to the switch for switch operation upon actuator movement, whereby a force applied to the push button portion in a direction generally perpendicular to the face is effective to operate the switch.

4. A switch assembly comprising a support having a face, an aperture defined in the face, a circuit board mounted on the support, the board surface extending transverse to the said face, the support and circuit board together defining a switch cavity, a switch including a movable contact and a stationary contact mounted on the circuit board and arranged for operation between open and closed state by movement of the movable contact generally perpendicular to the circuit board, a one-piece switch actuator having a longitudinal axis generally parallel to the circuit board, a push button portion on the axis extending partially through the aperture, and comprising an outer end of the actuator, an operator portion extending along the axis wholly within the switch cavity and comprising the inner end of the actuator, pivot means laterally spaced from the axis intermediate the inner and outer ends at one side of the actuator, and a switch contactor adjacent the switch contacts and laterally projecting from the inner end of the actuator on the same side thereof as the pivot means, and journal means on the support adjacent the circuit board pivotally mounting the actuator pivot means to allow rocking movement of the actuator in the switch cavity about a pivot axis substantially parallel to the circuit board and the face, whereby a force applied to the outer end of the actuator generally along the axis thereof is effective to move the switch contactor against the switch contacts to operate the switch.

* * * * *